US005695064A

United States Patent [19]

Huang et al.

[11] Patent Number: 5,695,064

[45] **Date of Patent: *Dec. 9, 1997**

[54] SELF-OPENING PLASTIC BAG PACK SYSTEM

[75] Inventors: Frank Feng Jung Huang; Daniel Huang, both of Tustin, Calif.

[73] Assignee: Durabag Co., Inc., Tustin, Calif.

[21] Appl. No.: 563,174

[22] Filed: Nov. 27, 1995

[ * ] Notice: The term of this patent shall not extend beyond the expiration date of Pat. No. 5,469,969.

Related U.S. Application Data

[63] Continuation-in-part of Ser. No. 206,191, Mar. 1, 1994, which is a continuation of Ser. No. 932,333, Aug. 19, 1992, which is a continuation-in-part of Ser. No. 904,446, Jun. 25, 1992, abandoned.

[51] Int. Cl.[6] ..... B65D 33/14

[52] U.S. Cl. ..... 206/554; 383/9; 383/37

[58] Field of Search ..... 206/554; 383/7–9, 383/37

[56] References Cited

U.S. PATENT DOCUMENTS

| | | | |
|---|---|---|---|
| 4,560,067 | 12/1985 | Reinmann | 206/554 |
| 5,188,235 | 2/1993 | Pierce et al. | 206/554 |
| 5,213,145 | 5/1993 | Huang et al. | 206/554 |
| 5,307,935 | 5/1994 | Kemanjian | 206/554 |
| 5,333,730 | 8/1994 | Boyd | 206/554 |
| 5,335,788 | 8/1994 | Beasley et al. | 206/554 |
| 5,346,310 | 9/1994 | Nguyen | 206/554 |
| 5,348,399 | 9/1994 | DeMatteis | 206/554 |
| 5,363,965 | 11/1994 | Nguyen | 206/554 |
| 5,469,969 | 11/1995 | Huang | 206/554 |

*Primary Examiner*—Jimmy G. Foster
*Attorney, Agent, or Firm*—Daniel R. Kimbell

[57] ABSTRACT

A self-opening pack of plastic bags for use with a bagging rack. The pack of plastic bags is formed of plastic material which has been exposed to corona surface treatment. Each plastic bag in the pack of bags has a central tab portion between its two upwardly extending handles, which are at the sides of the mouth of the T-shirt bags. A central tab portion is located on the front and rear walls in the mouth region of the plastic bags. The central tab portion has a neck region and head region. The central tab portion has an aperture for receiving a retaining hook of a bagging rack, and a central tab slit which extends across the central tab portion, except for uncut portions near side edges of the central tab. The tearing cuts pass through the stack of bags and follow a non-straight path. Frangible pressure bonding is formed along the bottom edge of the central tab slit. When the top bag is removed from the bagging rack, the next bag in the pack of bags will self-open into a open position for loading with merchandise. Inverted "J"-shaped slits are formed in the handles for supporting the bag handles on the bagging rack.

22 Claims, 6 Drawing Sheets

52
50
28
16
58
14
10c,d,etc
32
22
56
14
22
56
14
14
16
10b
18
20
10a
18

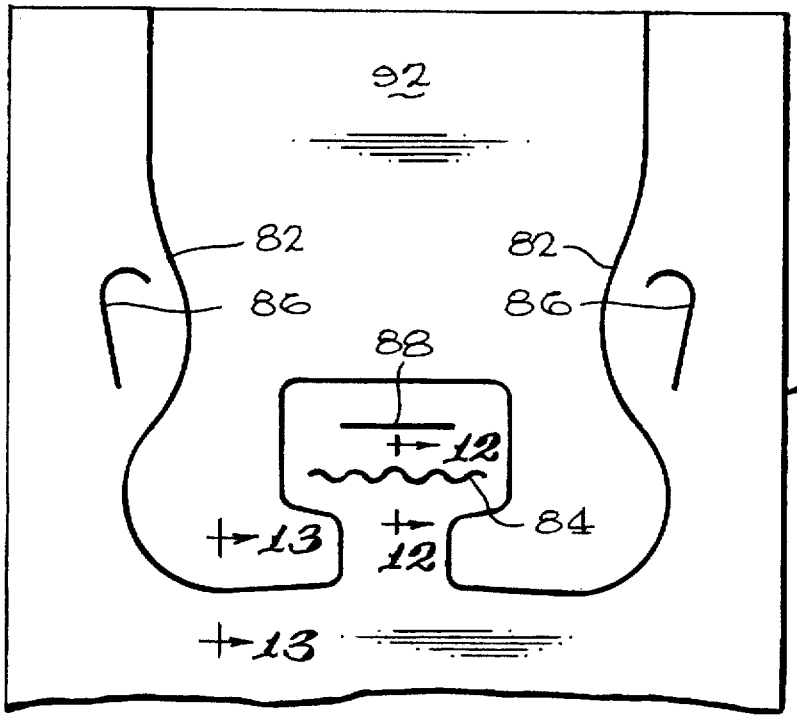
FIG. 11
FIG. 12
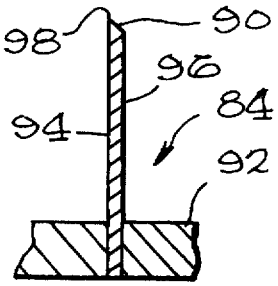
FIG. 13
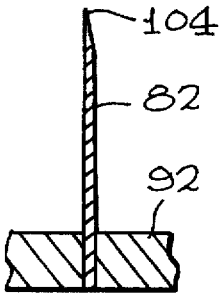
FIG. 14
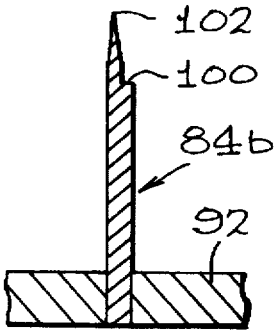
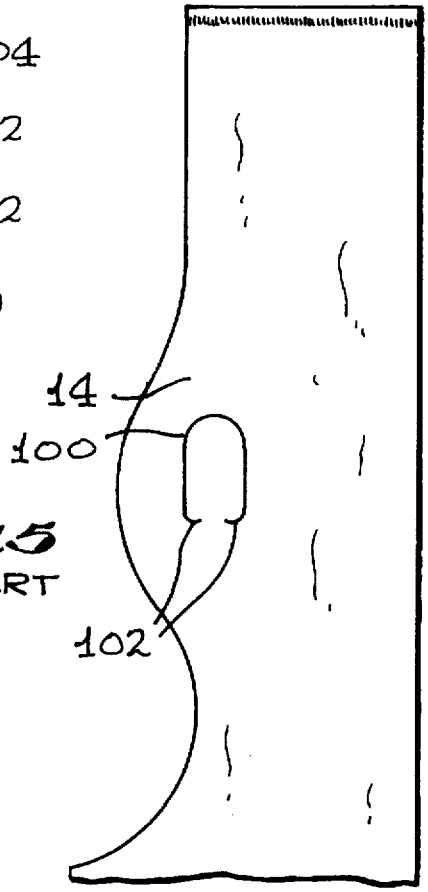
FIG. 15
PRIOR ART

SELF-OPENING PLASTIC BAG PACK SYSTEM

CROSS REFERENCE TO RELATED APPLICATIONS

This application is a continuation-in-part of application Ser. No. 08/206,191, filed Mar. 1, 1994, which is a continuation of application Ser. No. 07/932,333, filed Aug. 19, 1992, which is a continuation in-part of application Ser. No. 07/904,446, filed Jun. 25, 1992, now abandoned.

BACKGROUND OF THE INVENTION

1. Field of the Invention

This invention relates to plastic bags, and more particularly to a pack of T-shirt bags, merchandise bags, trash bags, and the like made preferably of polyolefins, and method of manufacturing same, which can be used with or without bagging racks and which provide for self-opening of the bags as each bag is removed from the pack of bags.

2. Description of the Prior Art

Since the mid-1980's, the use of plastic shopping bags has grown dramatically due to the great advantage plastic bags have over bags made of other materials, such as paper. Plastic bags are typically made of low or high density polyethylene (LDPE and HDPE, respectively), but can be made of any of the polyolefins. LDPE and HDPE bags are stronger, lighter and much more compact than paper bags when stacked, saving valuable storage space at the merchants' checkout counter and storage areas. These attributes also make these bags less expensive to transport. LDPE and HDPE bags can be manufactured and sold much less expensively than competing paper bags, making them the bags of choice for merchants. LDPE and HDPE bags are also environmentally friendly since they require 70 percent less energy to manufacture than competing paper bags and are readily recyclable, and when not recycled, are non-toxic when incinerated or disposed of in landfills.

Many groceries stores and other merchants now use a style of plastic bag to bag groceries called T-shirt bags. T-shirt bags are pleated bags which are closed, by heat sealing, at a bottom edge, and have a pair of integral handles extending upwardly to define an open mouth of the bag therebetween. The handles allow the grocery loaded bags to be more easily carried. Because high density polyethylene (HDPE) has a greater resistance to stretching and deformation, HDPE is generally used for making T-shirt bags, although LDPE and other polyolefins can also be used. T-shirt bags are normally provided in packs of aligned bags and these packs of bags are generally carried on a bagging racks for easy loading of the bags.

T-shirt bags are generally manufactured by the following process. A continuous tube of HDPE, LDPE, LHDPE, or some combination of these and other plastic materials having the desired color, thickness, diameter, and physical qualities such as tensile strength, stretch and tear resistance, is formed on a extruding machine. The continuous plastic tube is then passed over rollers to roll the continuous plastic tube onto a spool. Depending on whether or not the bags to be formed from the continuous tube of HDPE will be printed on one or both sides, the newly formed continuous tube may be subjected to corona surface treatment, wherein the side or sides of the continuous flattened tube of plastic which are to be later printed will be passed by high voltage corona discharge electrodes. Corona surface treatment affects electrical and chemical changes on the plastic's outer surface to prepare that surface of the bag for printing. Corona surface treatment also contributes to creating frangible pressure bonding and the reliable self-opening operation of the instant plastic bag pack system of the invention.

After being corona surface treated and rolled, the roll of continuous plastic tube is typically pleated on two sides in order to double from two to four the number of layers of plastic material on two side regions of the pleated roll. (The handles of the assembled bags are latter cut into this double thick side regions for added strength). A bagging machine is used to heat seam close and cut individual the pleated tubes into sections having a desired length, with the cut sections of the pleated tube at top and bottom edges forming closed and flattened pleated bags of a desired length and width (sometimes referred to as "pillowcases"), with the pleated sides being at both sides of the flatted pleated bags. Further downstream of the heat seaming and cutting step, the bags are stacked in aligned piles. Thereafter, a hydraulic die or other cutting method or tool is utilized to remove material at the stacked bags' top portion to form the handles and a central tab portion with a central tab slit for support of the pack of bags on a hook of a bagging neck and a tearing line below the central tab slit. Usually a heat weld is utilized to hold the stack of central tabs together, thus forming a pack of bags. Each handle will comprise four layers of material since they are cut out from the pleated side portions of the bag. This not only makes the handles stronger, but also thicker, and more comfortable to hold.

Despite the many advantages HDPE T-shirt bags have over paper bags, unlike thicker and stiffer paper bags with a discreet flat bottom, they are not self-standing. This is due to their relatively thin and flexible material. In grocery stores settings, where quick and easy loading of bags is desirable, T-shirt bags are provided in stacks or packs which are generally supported on a bagging rack as merchandise is loaded into the bags to overcome the lack of self-standing ability.

There are several popular styles of T-shirt bags available in packs of bags and bagging racks for use therewith, some main types of which will be discussed. In one type of pack of T-shirt bags and bagging racks used therewith, the bagging rack has a support base, a wire rear wall with a tab receiving hook, and two wire arms extending forwardly over the base. In the center top portion of the arms, the wire is formed so as to have a section which will spread and hold apart the handles of T-shirt bags engaged therewith to open up the mouth of the T-shirt bag. The pack of T-shirt bags used with these styles of bagging racks consists of a stack of overlapped and aligned bags which have a lower bag portion with two handles extending upwardly at both sides of the mouth of the bag. A central tab portion is provided on the mouth of the bags between the two handles, and the central tab portions of the pack of bags are heat-sealed together. The heat sealed central tabs thus form a stack or book of central tabs and have a central tab slit formed therethrough. The central tab slit is engaged with the tab receiving hook on the rear wall of the bagging rack, and the book of central tabs will remain engaged therewith, even after individual bags are removed. Below the central tab slit a tearing slit is provided which traverses almost the entire distance of the central tabs except for a small distance at both sides of the central tab portion. The tearing slit allows the individual bags to be torn off the pack of bags as they are needed, and looped onto the bagging rack.

A second major type of pack of T-shirt bag, and bagging rack designed to be used therewith, are disclosed in U.S. Pat. No. RE 33,264 to Baxley, et al. Another version of this style of bagging rack is disclosed in U.S. Pat. No. 4,840,336 to Stroh, et al. Both of these bagging racks have a bottom support base and a rear wire wall with a tab receiving hook located thereon. However, to open up each individual bag for loading, instead of looping the handles of the bags over the top of the support arm one at a time, as is done with the first type of pack of bags and rack, these racks have two handle support rods extending forwardly from the rear wire wall of the rack. The pack of T-shirt bags used with these styles of racks are similar to those used with the first type of rack, except that aligned apertures are formed on each handle of the pack of bags, through which pass the handle support rods of the bagging rack.

Both these styles of packs of T-shirt bags suffer from drawbacks; namely, the lack of a self-opening feature. In order to prepare a T-shirt bag for loading with merchandise, only the first layer of the bag material of the top bag, and no other layers must be pulled forward, thereby opening just the top bag. Since the HDPE material is very thin, typically between 1 to 0.5 mil thick (0.001 and 0.0005 inches), it is sometimes difficult for the checkout clerk or box boy to grasp just the top layer of bag material. One can often see a sponge or source of tacky material, such as a glue stick, retained at the top of bagging racks, with which the checkout clerk or box boy can dampen his or her fingers to aid in grasping just the top layer of material of the bag. However, this takes additional time and effort in the bagging process. This cycle will have to be repeated with each successive bag to be loaded.

Several approaches have been taken to overcome these problems. U.S. Pat. No. RE 33,264 to Baxley, et al. discloses a pack of T-shirt bags wherein spots of adhesive are placed between the rear wall of the forwardly lying bags and the front wall of the rearwardly lying bags. The use of these spots is intended to provide for self-opening of the bags as each bag is pulled off the rack. However, the use of spots of adhesive is undesirable from a cost standpoint because of the requirement of an extra manufacturing step of depositing spots of adhesive on the growing stack of closed bags as each subsequent closed bag is stacked thereon, before the die cutting step takes place. The Baxley et al. bag pack utilizes flaps formed through its handles which are bonded together for easy loading on a bagging rack.

U.S. Pat. No. 5,074,674 to Kuklies, et al. discloses a packs of bags similar to that of Baxley, et al. wherein the front wall of each bag is either relieved or removed in the region of the central tab so as not to be retained by the tab receiving hook on the bagging rack, purportedly allowing the front wall of the bag to be grasped more easily to open the bag. However, this style also requires an extra, and difficult manufacturing step of removing or relieving a portion of only the front wall of each bag. The pack of bags of Kuklies, et al. does not provide for self-opening of the bags.

U.S. Pat. No. 4,877,473 to Snowden, et al. discloses a pack of bags wherein the tearing line has a central arched portion which forms a sub tab. This sub tab can be easily grasped and pulled forward to pull the front wall of each bag to open that particular bag. However, each subsequent bag in the pack of bags must be opened in the same manner.

U.S. Pat. No. 5,188,235 to Pierce, et al. discloses a bag pack system with a central mounting tab on the mouth of the multiple stacked bags with a vertical perforation extending between a generally horizontal central mounting aperture and the bag mouth, to permit a bag to be removed without leaving the "book" portion of the central mounting tab on the bagging rack. In the Pierce, et al. bag pack cold pin holes are made through the handles above the handle apertures and through the central mounting tab on either side of the vertical perforation. The cold pin holes near the vertical perforation are said to provide a self-opening feature for the bags. However, in Applicant's experience, cold pin holes do not provide adequate frangible bonding necessary for a reliable self-opening feature.

U.S. Pat. No. 5,087,234 to Prader et al. discloses a method of forming a pack of easy-open T-shirt bags, wherein the bags have been corona discharge treated in the handle and bag mouth regions and such that the pressure and cutting action applied during the formation of the pack of bags will cause adjacent facing cut edges to releaseably act here together until a moderate force separates them. During the step of removing a topmost bag from a pack of bags on the rack, at least a portion of the cut edge of the mouth and handle region of the front wall of the next bag will follow the bag being removed for a short distance before separating. This opens the next bag, readying it ready for loading. Prader et al. states that the pressure necessary to effect the adhesion of the treated surface is supplied during the cutting step and that any pressure involved in the formation of the handles in the bag mouth and is satisfactory for adhesion. Accordingly, by Prader et al., one would expect light frangible bonding to be formed all along the cut edges of the bag packs handle, handle apertures and central mouth tab. In contrast, Applicant has found that the frangible bonding inherently formed when corona discharge treated plastic bag packs are cut does not result in a reliable self-opening feature.

U.S. Pat. No. 5,183,158 to Boyd et al. discloses a bag pack which includes a self-opening feature, arising out plural, i.e. upper and lower, releasable means between adjacent bags. The releasable means arises out of forming compression areas through the bag stack. Boyd et al. discloses three types of suitable releaseable means as including the use of low-tack pressure sensitive adhesive, the use of corona discharge treatment in combination with the application of pressure, and the application of considerable pressure through layers of adjacent bags. In Boyd, the preferred embodiment is to utilize considerable pressure through the layers of the bag pack in order to achieve a reasonable adhesion between the rear portion and front portion of each bag.

U.S. Pat. No. 5,335,788 to Beasley et al. discloses a self-opening polyethylene bag stack, (composed of at least 50% by weight of high density polyethylene) and process for forming the pack, which relies on the stack of bags being formed of corona treated polyethylene film which has been compressed under high pressure in localized, upper regions under the bag mouth, and preferably spaced below the cut lines forming the bag mouth, to thus form an area of frangible bonding which is available to create the self-opening feature. Beasley et al. stresses that the conditions of heat and pressure that readily cause blocking in corona treated low density polyethelene (LDPE) and linear low density polyethylene (LLDPE) are insufficient for high density polyethlene (HDPE). Beasley et al. further states that even when the cutting blades are dulled in order to increase the degree of pressure exerted on the bags during the cutting process, self-adhesion of adjacent bags for self-opening is not achieved with HDPE.

Despite the attempts to overcome the problems associated with these presently available T-shirt bags, there continues to remain a need for an improved pack of T-shirt bags which can be used with a variety of bagging racks, which can be easily manufactured, and which provides for self-opening of each bag in the pack of bags.

SUMMARY OF THE INVENTION

The present invention overcomes the above noted deficiencies of the presently available T-shirt bags by providing a new type of T-shirt bag which can be readily used with a variety of different bagging racks, and which provides for self-opening of bags as the immediately forwardly lying bag is removed from the pack of bags.

The present invention provides a pack of self-opening bags for use with bagging racks, comprising:

a plurality of bags, each of said bags having opposed walls with outer surfaces, said outer surfaces being corona surface treated and aligned in a stack, said opposed walls being closed at a bottom edge and at least partially openable at a top region to define a mouth region, a central tab portion being located on said opposed walls of each of said bags and extending above said mouth region of said bags, said central tab portion having a neck region which extends above the mouth region and a head region extending above said neck region, said central tab portion having a central tab slit extending thereacross in an interface region between the neck region and head region, except for uncut portions near said side edges of said central tab portion, said central tab slit being formed through said stack of bags and following a non-straight path, said walls of said pack of bags being held together by knife-blade bonding adjacent the lower side of said central tab slit passing through said central tab portions, said central tab portions in said stack being affixed together above said central tab slit to form said pack of self-opening bags.

The invention further provides a pack of self-opening bags for use with bagging racks, comprising:

a plurality of bags, each bag having a front wall and a rear wall, corona surface treated on outer surfaces of said front and rear walls;

side walls joining said front and rear walls, said bags having a bottom edge which is closed and a partially opened top edge;

a pair of integral handles extending upwardly from said top edge with a mouth region located between said integral handles, said integral handles having elongate apertures located therethrough; and central tab portions located on said front and rear walls in said mouth region of said bags, said central tab portions having a neck region which extends above said mouth region and a head region which extends above said neck region, an aperture for receiving a retaining hook of a bagging rack, and a central tab slit which extends across said central tab portion in an interface region between said neck region and said head region, except for uncut portions adjacent said side edges of said central tab portion, said central tab slit being located below said aperture, said pack of bags being held together along the bottom edge of said central tab slits which pass through said central tab portions by knife-blade bonding.

BRIEF DESCRIPTION OF THE DRAWINGS

FIG. 11 is a top plan view of a die used to cut and form the pack of bags from a stack of pillowcases.

FIG. 12 is a cross-sectional view through lines 12—12 of FIG. 11, showing a first embodiment of the cutting blade used to form the frangible bonds on the lower edge of the central tab slit.

FIG. 13 is a cross-sectional view through lines 13—13 of FIG. 11, showing the cutting blade used to form the outlines of the bag handles and mouth and central tab regions.

FIG. 14 is a cross-sectional view through lines 12—12, showing an alternate embodiment of the cutting blade used to form the knife-blade bonding.

FIG. 15 is a top plan view of a prior art, inverted horseshoe-shaped handle apertures.

DESCRIPTION OF THE PREFERRED EMBODIMENT

Figure 1:
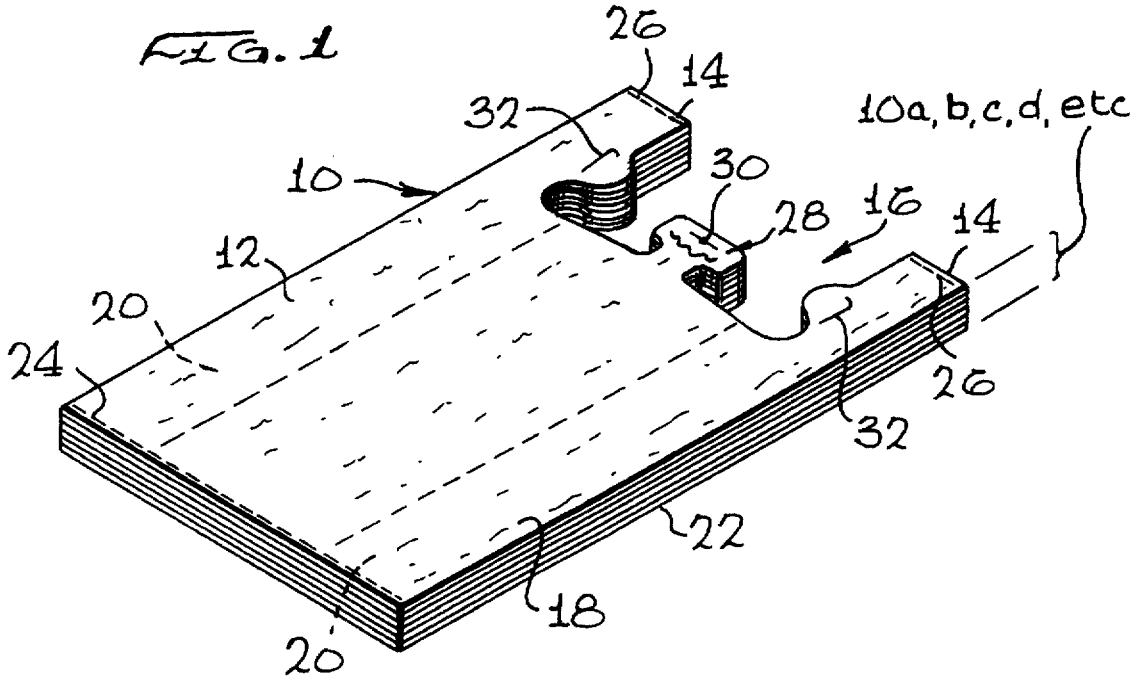
FIG. 1 is a perspective view of a pack of bags of the invention.

Referring now to the drawings, there is illustrated in FIGS. 1–10 various views of the pack of T-shirt bags of the instant invention. The pack of plastic T-shirt bags 10*a, b, c, d*, etc. consists of a stack of overlapped bags 10*a*, 10*b*, 10*c*, 10*d*, etc., each of which has a lower bag portion 12 with two handles 14 extending upwardly from the lower bag portion 12 at both sides of the mouth 16 of the bags 10*a, b, c, d*, etc. The individual bags 10*a, b, c, d*, etc. have a front wall 18, pleated side walls 20 and a rear wall 22 (see FIGS. 6 and 8–11.) Each of the T-shirt bags 10 of the invention are heat seamed together at their bottom edges 24 and at the top edges 26 of their handles 14. Apertures, such as in the shape of inverted J-shaped slits 32, are formed in the handles 14. A central tab portion 28 extends above the mouth 16 of the bags 10*a, b, c, d*, etc. between the two handles 14, and the central tab portions (or central tab regions) 28 are preferably heat welded together at 30. The heat sealed central tab portions 28 thus forms a stack or "book" of aligned central tab portions 28. Hereinafter, the term "central tab portion" and "central tab region" 28 may sometimes be used interchangeably.

The individual bags 10*a, b, c, d*, etc. are formed from a continuous tube of plastic material which is treated on its outside surface by corona surface treatment. Equipment such as that offered by Kasuga Denki Co., Ltd., of Tokyo, Japan, can be used. The corona surface treatment affects the changes to the outer surface of the continuous tube of plastic material used to form the pack of bags 10*a, b, c, d*, etc. Corona treatment is a necessary step used to prepare the outer surface of the plastic material to received printing inks. Without corona treatment, printing inks do not satisfactorily adhere to the plastic material. The degree of corona film treatment used is within the standard range used to treat plastic material for printing, i.e. 40–46 dyne/cm. When adjacent layers of corona surface treated plastic material are compressed together, they tend to frangibly bond together. The pack of self-opening bags of the invention can be made from LLDPE, LDPE, HDPE, and combinations of these materials.

Figure 2:
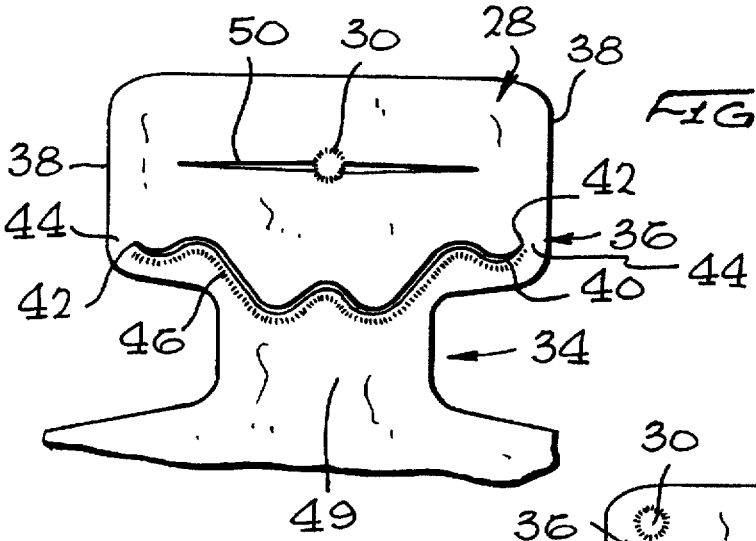
FIG. 2 is a fragmentary view of the central tab area of a first embodiment of the pack of bags of FIG. 1, showing frangible bonding adjacent a sinusoidal central tab slit.
Figure 3:
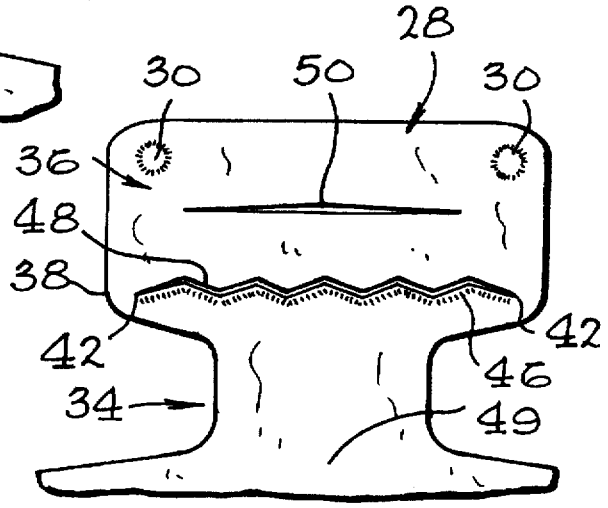
FIG. 3 is a fragmentary view of the central necked tab of a second embodiment of the pack of bags, showing frangible bonding adjacent the zigzag central tab slit.
Figure 4:
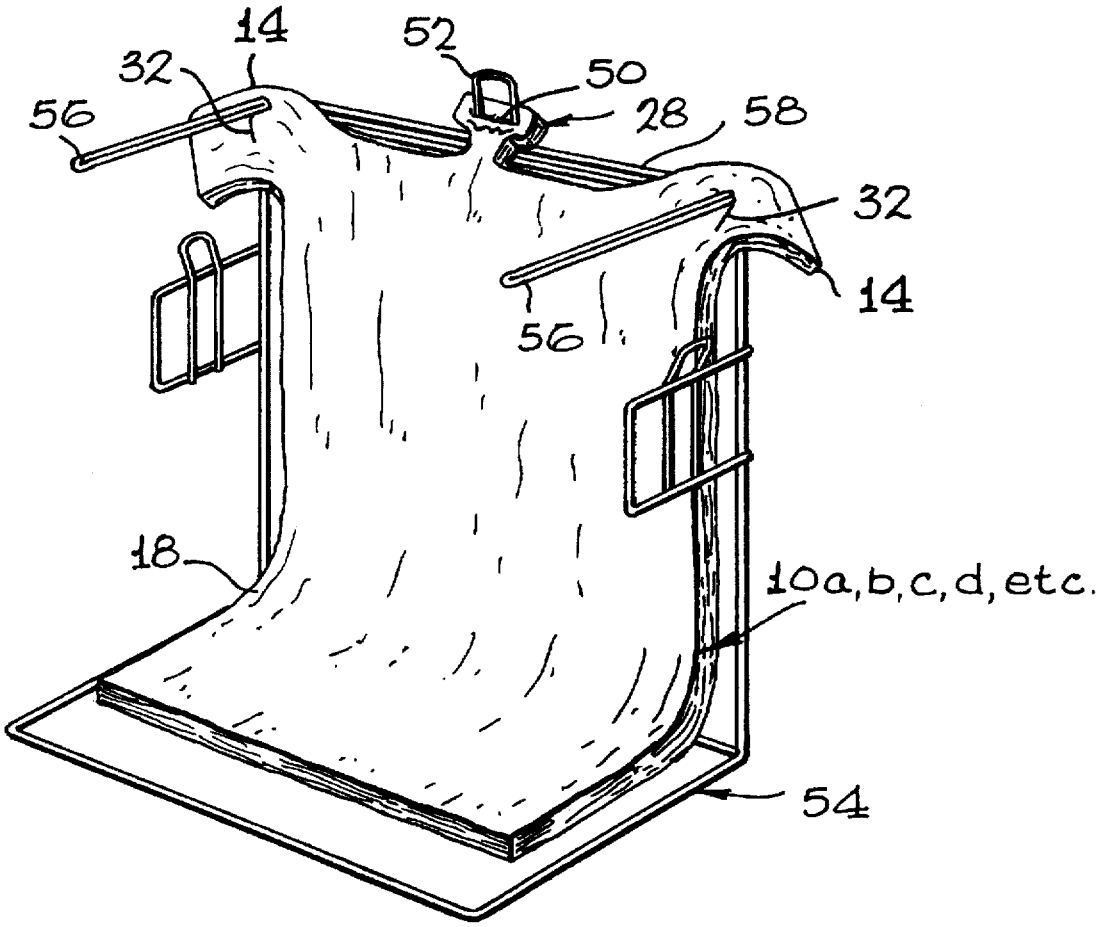
FIG. 4 is a perspective view of the pack of bags of FIG. 1 hanging on a bagging rack, before the front bag is readied for loading.
Figure 5:
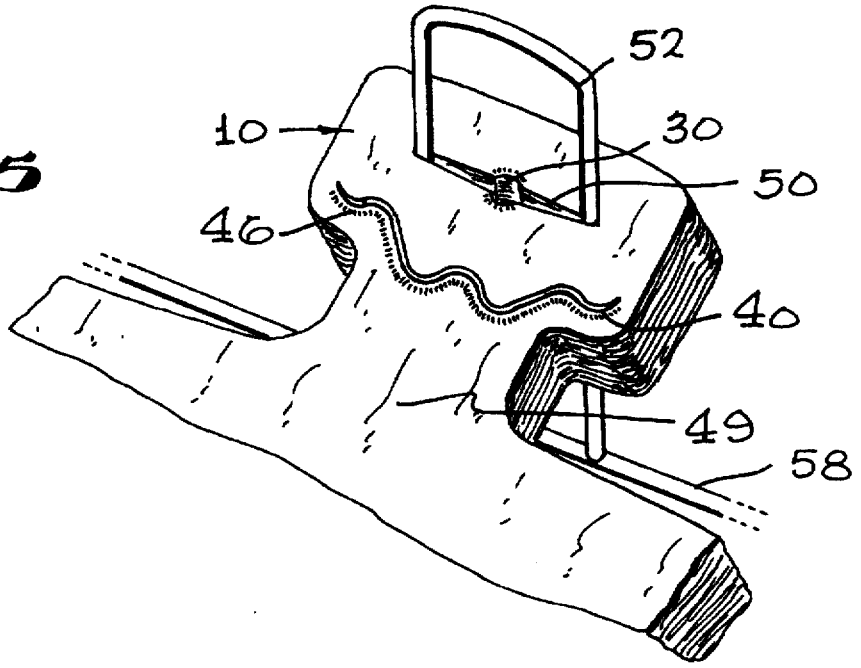
FIG. 5 is a fragmentary perspective view of the central tab of the pack of bags, hooked on a hook of the bagging rack shown in of FIG. 4.
Figure 6:
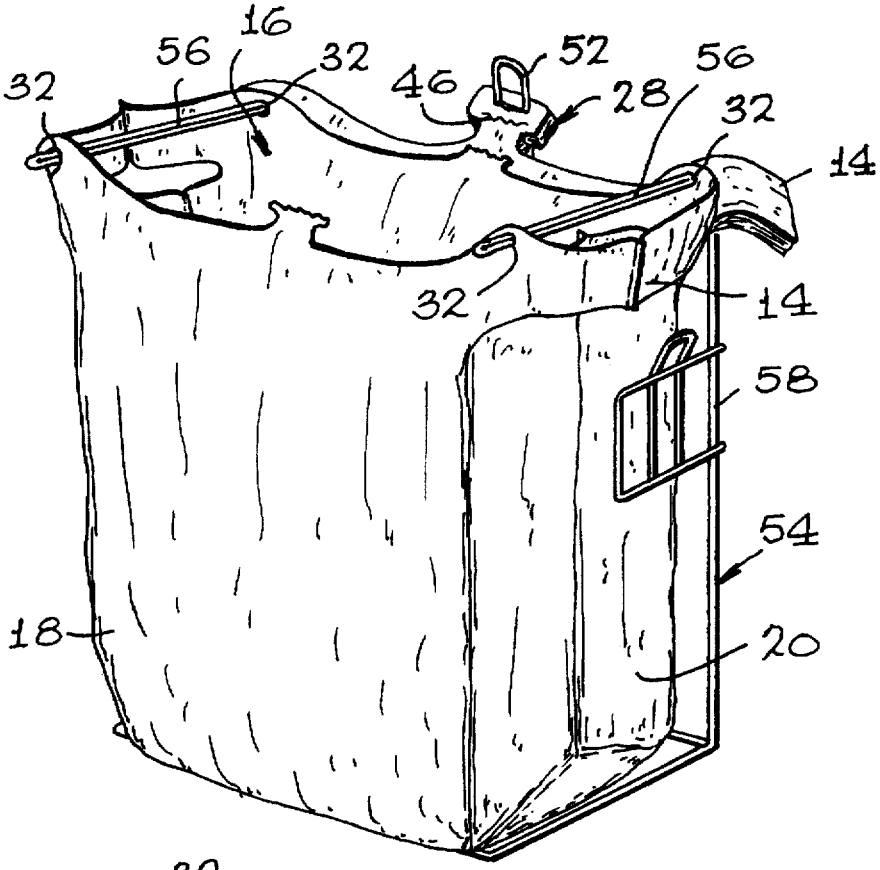
FIG. 6 is a perspective view of the first embodiment of the pack of bags of FIG. 1 on the bagging rack, after being readied for loading.

Referring to FIGS. 2 and 3, the central tab portion 28 is shown. The central tab portion 28 has a neck region or portion 34 and a head region or portion 36. Preferably, 34 is made narrower than the head region 36. Located above the mouth 16 of the bag back, in the interface region between the neck region 34 and the head region 36 is a central tab slit 40 which extends through the stack of bags 10*a, b, c, d*, etc., between terminal points 42 near the side edges 38 of the neck region 34. Uncut areas of material 44 remain between the terminal ends 42 of the central tab slit 40 and the side edges 38. The inventors have found that an uncut area 44 of about 1 to 3 millimeters is ideal for the function of the self-opening feature, which will be described further below. An area of frangible cold pressure, or knife-blade compression bonding ("central tab slit bonding") 46 is formed below the central tab slit 40 and extends through the stack of bags 10*a, b, c, d*, etc. The central tab slit bonding 46 is formed directly adjacent the central tab slit 40. A mounting aperture 50 is formed above the central tab slit 28 in the head region 36 of the central tab portion 28. The heat weld 30 is shown as passing through the central mounting tab 28 above the mounting aperture 50, but can be formed anywhere above the central tab slit 40.

In the embodiment of FIG. 2, the central tab slit 40 follows a sinusoidal path, which is longer in length than the straight line distance between its two endpoints 40. In the embodiment of FIG. 3, the central tab slit 48 has a zigzag contour, which is also longer in length than its straightline distance between its endpoints 42, but the other features of the central tab 28 are otherwise the same. The central tab slits 40 and 48 can follow along a generally straight path or preferably, a downwardly directed path, as does the sinusoidal slit 40 of FIG. 2. The advantage of having the central tab slit 40 have a longer than straightline distance between its end points is twofold. First, it allows a longer length of knife-blade bonding 46 to be formed. Second, it results in a relaxation of bag tension below the central tab slit 40, where the knife-blade bonding 46 or 48 is formed above area 49.

Referring to FIGS. 4–10, the pack of bags 10*a, b, c, d*, etc. is carried in its mouth region 16 by the mounting aperture 50 of its central tab portion 28 being hooked on a central mounting tab hook 52 of a bagging rack 54. In this embodiment of the bagging rack 54, the handles 54 are carried on forwardly extending arms 56 of the bagging rack 54, which arms 56 pass through the handle apertures 32 to support the handles 14. The central mounting hook 52 is mounted on a rear wall 58 of the bagging rack 54.

Figure 7:
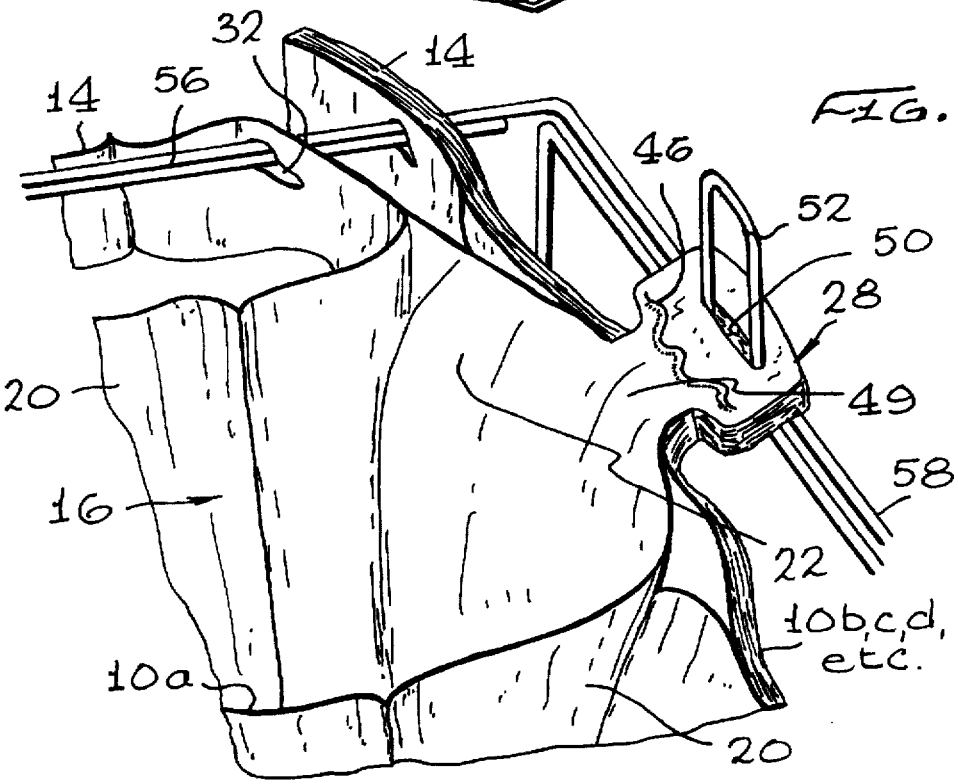
FIG. 7 is a top perspective view of a bag being pulled forward from the pack of bags on the bagging rack of FIG. 6.
Figure 8:
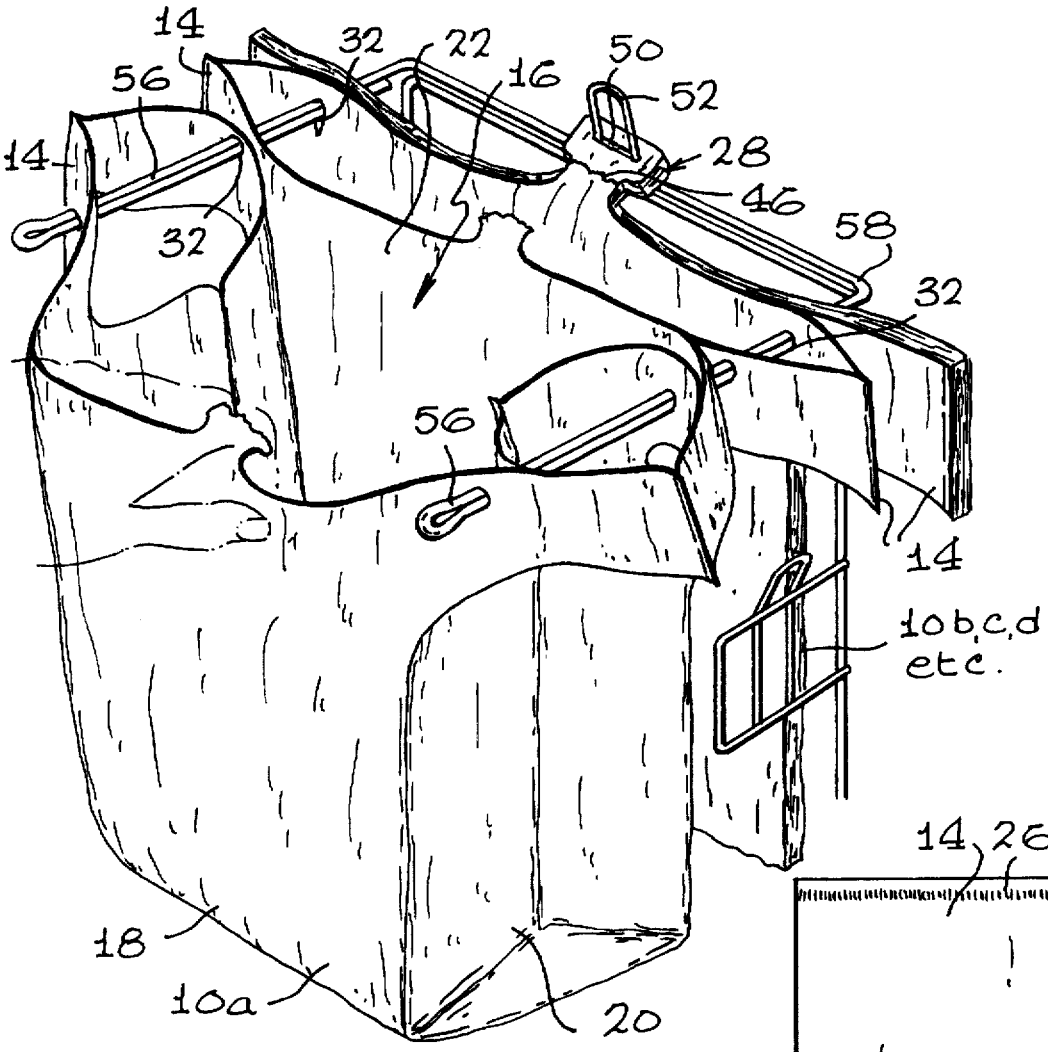
FIG. 8 is a further top perspective view of the bag and pack of bags on a bagging rack of FIG. 7 immediately after being torn from the book of central tabs.
Figure 9:
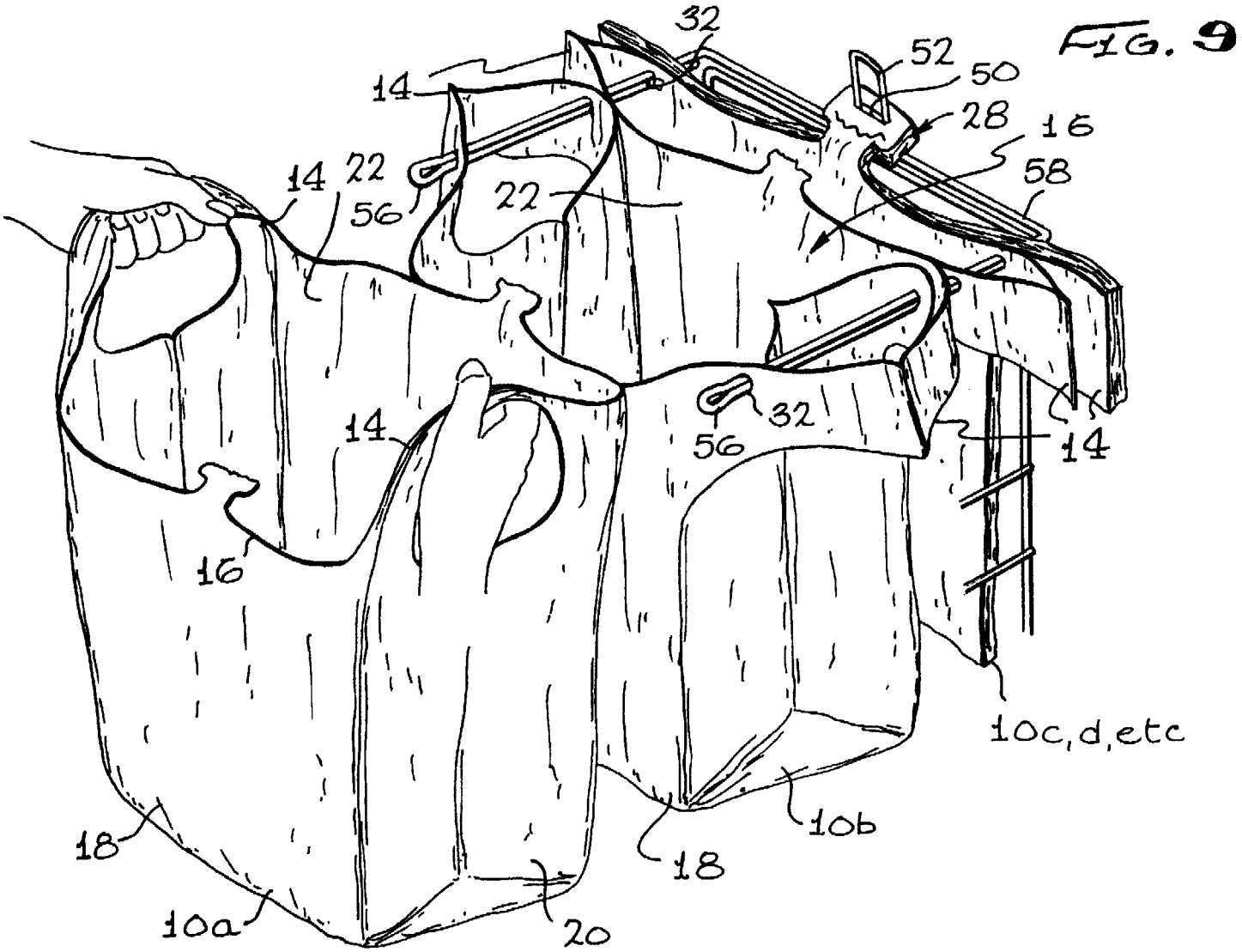
FIG. 9 is yet a further top perspective view of the bag and pack of bags of FIG. 8, as the top bag is completely removed from the bagging rack and the next bag is prepared for loading.

Referring now to FIGS. 7–9, the area of knife-blade bonding 46 on the lower edge of the central tab slit 40 will frangibly bond to the areas of the rear wall 22 of frontwardly lying bags (i.e. 10*a*) to the area of front wall 18 of the rearwardly lying (i.e. 10*b*). The bag pack 10*a, b, c, d*, etc. is placed on a bagging rack 54, with its mounting aperture 50 hooked on the central mounting tab hook 52. As groceries and other merchandise are placed in the front, open bag 10*a*, the weight of these goods will create a downward pulling tension on rear wall 22 of the open front bag 10*a*. This places downward tension on the uncut areas 44 on both sides of the central tab slit 40, which causes the uncut materials 44 of the rear wall 22 of the frontwardly bag 10*a* and the front wall 18 of a rearwardly lying bag 10*b* to tear through, without disturbing the knife-blade frangible bonding 46 on the lower edge of the central tab slit 40. The elongate shape of the central tab slit 40 acts to relieve tension along its lower edge and the knife-edge bond area 46 formed adjacent the lower edge of the central tab slit 40. This reduction in tension helps concentrate the pulling force necessary to break the uncut regions 44 before acting on the knife-edge bonds 46, thus ensuring that the self-opening feature is retained. The use of bags with the neck helps focus the pulling force on the uncut areas 44, which contributes to reliable functioning of the self-opening feature of the bag pack. The area of knife blade bonding 46 further acts to hold the layers of bag together as the frontmost bag is removed from the bagging rack, and causes the bag to open relatively widely, to ready it for loading with merchandise.

Figure 10:
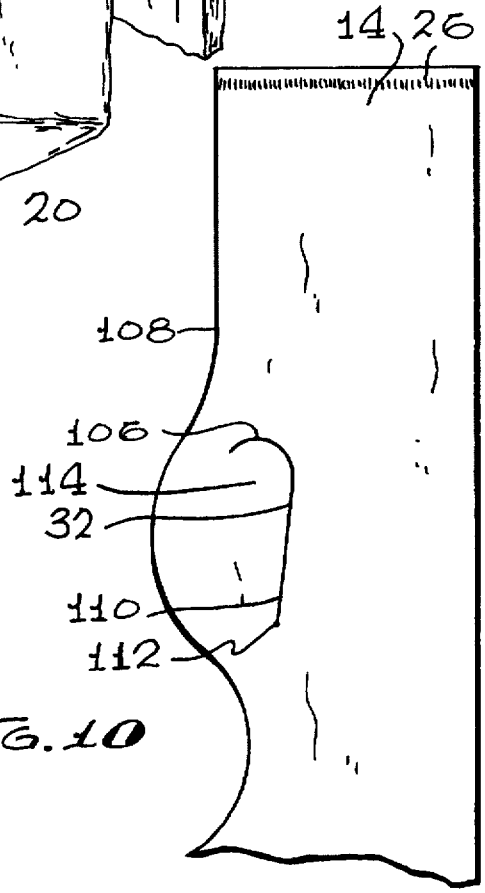
FIG. 10 is a detail showing the handle aperture in the handle of the bag pack.

Referring to FIG. 10, the inverted "J"-shaped handle apertures 32 have benefits not found with prior art inverted horseshoe shaped handle apertures 100, such as shown in FIG. 15. In these prior art apertures 100, the cut ends 102 of the horseshoe are turned inwardly and upwardly. The theory behind the prior art inverted horseshoe-shaped handle aperture cut 100 is that any slit or cut in a bag is a potential tear and rip initiation point, which can damage the integrity of the bag. By using an inverted, horseshoe shaped handle aperture cut 100 with turned up and in ends 102, any potential tearing at the ends 102 will tend to be propagated inwardly and upwardly, into the flap 104 formed by the cut 100. While inverted horseshoe shaped handle apertures 100 do accomplish the intended purpose, they reduce the effective, continuous width of the handles and can somewhat weaken the handles. By using an inverted "J-shaped" handle aperture slit 32, as shown in FIGS. 1 and 10, the strength of the bag handles 14 is not substantially compromised. In fact, bags with these apertures are just as strong or even stronger than bags with inverted horseshoe-shaped handle apertures.

The upper end 106 of the "J"-shaped apertures 32 curves toward the inner side edges 108 of the handles 14 from a relatively straight portion 110 with an uncurved bottom end 112. The straight portion 110 is preferably angled slightly inwardly toward an inner side edge 108 of the handles 14. The upper curved end 108 need not be very wide since the bag material of the flap regions 114 in the pack of bags 10*a, b, c, d*, etc. formed between the cut lines 106 and 110 of the handle aperture 32 will push out sufficiently when the bag pack 10*a, b, c, d*, etc. is loaded on a bagging rack to permit easy placement of the pack of bags 10*a, b, c, d*, etc. Moreover, by using an elongate "J"-shaped aperture 32, the bag pack 10*a, b, c, d*, etc. can be used on a greater variety of racks, having different spacings between their support arms.

Although the pack of bags 10*a, b, c, d*, etc. of the invention can be used with any number of available bagging racks, the pack of bags 10*a, b, c, d*, etc. is adapted to function particularly well with the bagging racks shown in FIGS. 4–9.

Referring to FIGS. 4–9, after loading a new pack of bags 10*a, b, c, d*, etc. on the bagging rack 54, the checkout clerk or box boy first grasps only the front wall 18 of the frontmost bag 10*a* and pulls it forward to open the mouth 16 of the bag 10*a*. The front wall 18 only of the top bag 10*a* will be torn free from the pack of bags 10*a, b, c, d*, etc. at its central tab portion 28 along its central tab slit 34 and its uncut portion 44, and the rear wall 22 of the bag 10*a* will stay attached to the hook 54 the central tab portions 28 at its uncut portions 44. The checkout clerk or box boy then pulls the frontmost bag 10*a* forward on the forwardly extending arms 56 to free the loaded bag 10*a* and to prepare the next bag 10*b* for loading. As the frontmost bag 10*a*is loaded with merchandise, the weight thereof tends to put tension on the rear wall 22. As explained above, this tension tears the uncut material 44 of the rear wall 22 of the frontmost bag 10*a* and the front wall 18 of the following bag 10*b*. After the frontmost bag 10*a* is loaded with merchandise, its handles 14 are removed from the forwardly extending arms 56, and the loaded bag 10*a* is removed from the bagging rack 54. This action causes only the front wall 18 and side wall 20 of the next bag 10*b* in the stack of bags 10*a, b, c, d*, etc. to be pulled forward to open bag 10*b* without the checkout clerk or box boy needing to grasp the material of the top wall 18 of the bag 10*b*.

As best shown in FIGS. 4–9, even if the uncut regions 44 are not torn through when the bag 10*a* is loaded with merchandise, when the forward lying bag 10*a* is pulled forward to remove it from a bagging rack 54, most of the forward pulling tension will be delivered along the top edges 60 of the bags' mouth 16 to uncut areas 44 at both sides of the central tab slit 40, thereby tearing through uncut areas 44. However, because of the knife-blade bonding 46 of the rear and front layers 18 and 22 of adjacent bags 10*a* and 10*b* below the bottom edge of the central tab slit 40, the action of pulling the top bag 10*a* will also pull forward of the front wall 18 of the immediately following bag 10*b*, resulting in the next bag 10*b* in the pack opening up. Thereafter, by merely withdrawing consecutive bags from the top of the pack of bags 10*a, b, c, d*, etc., the bag immediately following will open up without the clerk or box boy needing to grasp just the top layer of material 18 of the bag 10*b*. The shapes of the central tab slit 40 assists in this mechanism since it is longer than the straight line distance between its end points 42, which tends to relieve tension on the frangible bonds 46.

The type of plastic material used, i.e. LDPE, HDPE, etc., and its thickness, may require slight adjustments in the width of uncut areas 44 straddling the ends 42 of the central tab slit 40 in the pack of bags 10*a, b, c, d*, etc. used with the bagging rack 56 since different plastic and polyolefin materials will tend to have different degrees of frangible bonding strength. However, the degree of compression necessary is supplied by the normal pressure required to die cut the bags.

The central tab slit 40 and its adjacent knife-blade bonds 46 are formed by compressing adjacent layers of the corona treated plastic material together under normal cutting pressure, with a blunt compression member, to thus form the knife-edge bonds 46. As will be discussed further below, this process is preferably carried out during the die cutting step of making the pack of bags.

The manufacturing process used to manufacture the stack of bags 10*a, b, c, d*, etc. of the invention is basically the same as is used to manufacture typical T-shirt bags which use a plastic material which has exposed to corona surface treatment on the outside wall surfaces of the bags.

Referring now to FIGS. 11–13, the die 80 used to form the pack of self-opening bags 10*a, b, c, d*, etc. is shown. The die consists of blade portions 82, 84, 86 and 88. The blade portions 82, 84, 86 and 88 are permanently mounted to a backing plate 92 which can comprise plywood or other materials. Blade portion 82 is used to cut the handles 14, mouth area 16 and the central mounting tab 28 which extends above the mouth area 16. Blade portions 86 are used to cut the handle apertures 32. Blade portions 82, 86, and 88 comprise conventional sharp and thin cutting blades. Blade portion 88 is used to cut the central mounting aperture 50.

Blade portion 84 is different from the other blades 82, 86, and 88 in that it is thicker, and has a wider and less steeply angled cutting edge 90, which slopes downwardly from a first side 94 to a second side 96 of the blade 84. This wider, and less steeply angled cutting edge 90 will, when used to cut through the stack of uncut and corona treated bags under normal pressure, form the central tab slit 40 and the knife-blade bonding 46, the slit 40 being formed by the tipmost edge 98 and the knife-blade bonding 46 formed by the angled cutting edge 96.

Referring to FIG. 14, an alternate embodiment of the blade portion 84*b* is shown. In this embodiment, rather than utilizing a relative wide and shallow angled cutting edge, a flat and horizontal compression shoulder 100 is set back from a sharp cutting edge 102, where the flat compression shoulder will form the knife-blade bonding when applied under normal pressure to a stack of corona treated blanks.

FIG. 13 is a cross-sectional view of the blade portion 82 with its rear region imbedded in the backing plate 92, which can be plywood, plastic or other materials. The blade portions 82 has a sharp front cutting edge 104.

It has been observed by the inventors that the knife-blade bond strength formed, and thus the reliability of the self-opening feature of a bag pack will normally not reach a maximum immediately following the manufacture of packs of self-opening bags, but will increase after a few weeks time. The inventors have found that the frangible bond strength can be maximized to its full strength immediately by treating the exterior surface of the plastic material of the continuous tube of plastic tube with static charging, to place a positive static charge on one exterior surface, e.g. the part which will be a front wall of the bag and a negative charge on the other exterior surface, e.g. on the part which will be a rear wall 22 of the bags. As the pillowcases formed are placed in a stack, the opposite charges cause static adhesion between opposite outer walls of the stacked bags. When the bag pack 10*a, b, c, d*, etc. is formed, the frangible bonding will achieve a maximum strength immediately. Static charging equipment such as offered by the Simco Company, Inc. of Hatfield, Penn., function well. The spacing between the charging bars used to positively or negative charge the plastic material and the plastic sheet material, and the voltage delivered to the changing bars must be adjusted so that the static charge placed on the material will be present just on the outer surfaces of the plastic material, without penetrating too deep, otherwise adjacent front and rear walls of bag material in each bag will be attracted together.

As can be appreciated, the self-opening feature of the pack of bags 10*a, b, c, d*, etc. is accomplished by a simple and reliable method of manufacture.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A pack of self-opening bags for use with bagging racks, comprising:

a plurality of bags, each of said bags having opposed walls with outer surfaces, said outer surfaces being corona surface treated and aligned in a stack, said opposed walls being closed at a bottom edge and at least partially openable at a top region to define a mouth region, a central tab portion being located on said opposed walls of each of said bags and extending above said mouth region of said bags, said central tab portion having a neck region which extends above the mouth region and a head region extending above said neck region, said central tab portion having a central tab slit extending thereacross in an interface region between the neck region and head region, except for uncut portions near said side edges of said central tab portion, said central tab slit being formed through said stack of bags and following a non-straight path, said walls of said pack of bags being frangibly and non-adhesively held together by cold-pressure knife-blade bonding adjacent the lower side of said central tab slit passing through said central tab portions in the neck region, said central tab portions in said stack being affixed together above said central tab slit to form said pack of self-opening bags.

2. The pack of self-opening bags of claim 1, wherein said central tab portion further comprises a mounting aperture formed above said central tab slit, said mounting aperture being engageable with a hook located on a bagging rack.

3. The pack of self-opening bags of claim 1, wherein said central tab slit follows a generally sinusoidal path.

4. The pack of self-opening bags of claim 1, wherein said central tab slit follows a generally zigzag path.

5. The pack of self-opening bags of claim 1, wherein said uncut portions of said central tab slit are in the range of 1 to 3 millimeters wide.

6. The pack of self-opening bags of claim 1, wherein said bags further comprise a pair of integral handles which extend upwardly at both sides of said mouth.

7. The pack of self-opening bags of claim 6, wherein inverted "J"-shaped slits are formed in said handles for suspension of said handles on a bagging rack.

8. The pack of self-opening bags of claim 1, wherein said bags are pleated.

9. The pack of self-opening bags of claim 1, wherein said central tab portions in said pack of bags are attached together by heat-sealing.

10. The pack of self-opening bags of claim 1, wherein said central tab slit is about 10 percent or greater in length than the straight line distance between its endpoints.

11. The pack of self-opening bags of claim 1, wherein said knife-blade bonding is formed on the lower edge of said central tab slit.

12. The pack of self-opening bags of claim 11, wherein the knife-blade bonding is formed by a relatively thick knife blade with a shallow angled cutting edge.

13. The pack of self-opening bags of claim 1, wherein said pack of bags is formed from plastic material which has been at least partially corona discharge treated.

14. The pack of self-opening bag of claim 1, wherein said pack of self-opening bags is formed from plastic material which has been statically charged.

15. A pack of self-opening bags for use with bagging racks, comprising:

a plurality of bags, each bag having a front wall and a rear wall, corona surface treated on outer surfaces of said from and rear walls;

side walls joining said front and rear walls, said bags having a bottom edge which is closed and a partially opened top edge;

a pair of integral handles extending upwardly from said top edge with a mouth region located between said integral handles, said integral handles having apertures located therethrough; and central tab portions located on said front and rear walls in said mouth region of said bags, said central tab portions having a neck region which extends above said mouth region and a head region which extends above said neck region, an aperture for receiving a retaining hook of a bagging rack, and a central tab slit which extends across said central tab portion in an interface region between said neck region and said head region, except for uncut portions adjacent said side edges of said central tab portion, said central tab slit being located below said aperture, said pack of bags being frangible and non-adhesively held together along the bottom edge of said central tab slits which pass through said central tab portions in the neck region by cold-pressure knife-blade bonding, said cold-pressure knife-blade bonding creating non-adhesive frangible bonding in the neck region.

16. The stack of self-opening bags of claim 15, wherein said central tab slit passes through said stack of bags and follow a non-straight path.

17. The stack of self-opening bags of claim 15, wherein said central tab portions are attached together by a heat sealed hole.

18. The stack of self-opening bags of claim 15, wherein said uncut portions of said central tab portions are in the range of 1 to 3 millimeters wide.

19. The pack of self-opening bags of claim 15, wherein said apertures in said handles comprise inverted "J"-shaped slits.

20. The pack of self-opening bags of claim 15, wherein the knife-blade bonding formed along the bottom edge of the central tab slit is formed by a relatively thick knife-blade with a shallow angled cutting edge.

21. The pack of self-opening bags of claim 15, wherein said pack of bags is formed from plastic material which has been at least partially corona discharge treated.

22. The pack of self-opening bags of claim 15, wherein said pack of self-opening bags is formed from plastic material which has been statically charged.

* * * * *